US005305767A

United States Patent [19]

Ivanov

[11] Patent Number: 5,305,767

[45] Date of Patent: Apr. 26, 1994

[54] COMB

[76] Inventor: Yuri Ivanov, 2120 Cruger Ave., Bronx, N.Y. 10462

[21] Appl. No.: 57,629

[22] Filed: May 7, 1993

[51] Int. Cl.[5] ..... A45D 24/00

[52] U.S. Cl. ..... 32/151; 132/144; 132/152

[58] Field of Search ..... 132/144, 145, 151, 152, 132/153, 154, 155

[56] References Cited

U.S. PATENT DOCUMENTS

| | | | |
|---|---|---|---|
| 1,643,168 | 9/1927 | Nevotti | 132/151 |
| 1,678,891 | 7/1928 | Walsh | 132/144 |
| 2,005,187 | 6/1935 | Halloh | 132/145 |
| 2,618,276 | 11/1952 | Hamparson et al. | 132/152 |
| 2,808,062 | 10/1957 | Schiffman | 132/151 |
| 3,542,040 | 11/1970 | Poe | 132/151 |
| 3,977,420 | 8/1976 | Yalof | 132/151 |
| 4,936,259 | 6/1990 | Owen et al. | 132/151 |

FOREIGN PATENT DOCUMENTS

| | | | |
|---|---|---|---|
| 993998 | 11/1951 | France | 132/151 |
| 402129 | 2/1943 | Italy | 132/151 |
| 363418 | 12/1931 | United Kingdom | 132/152 |

*Primary Examiner*—Gene Mancene
*Assistant Examiner*—Frank A. LaViola
*Attorney, Agent, or Firm*—I. Zborovsky

[57] ABSTRACT

A comb has a plurality of prongs each having two prong parts movable relative to one another between an open position in which hair can engage between them and a closed position in which the hair are clamped between them, a user-actuated element for moving the prong parts to one of the positions, and an automatic returning element for returning the prong part to an initial position.

9 Claims, 4 Drawing Sheets

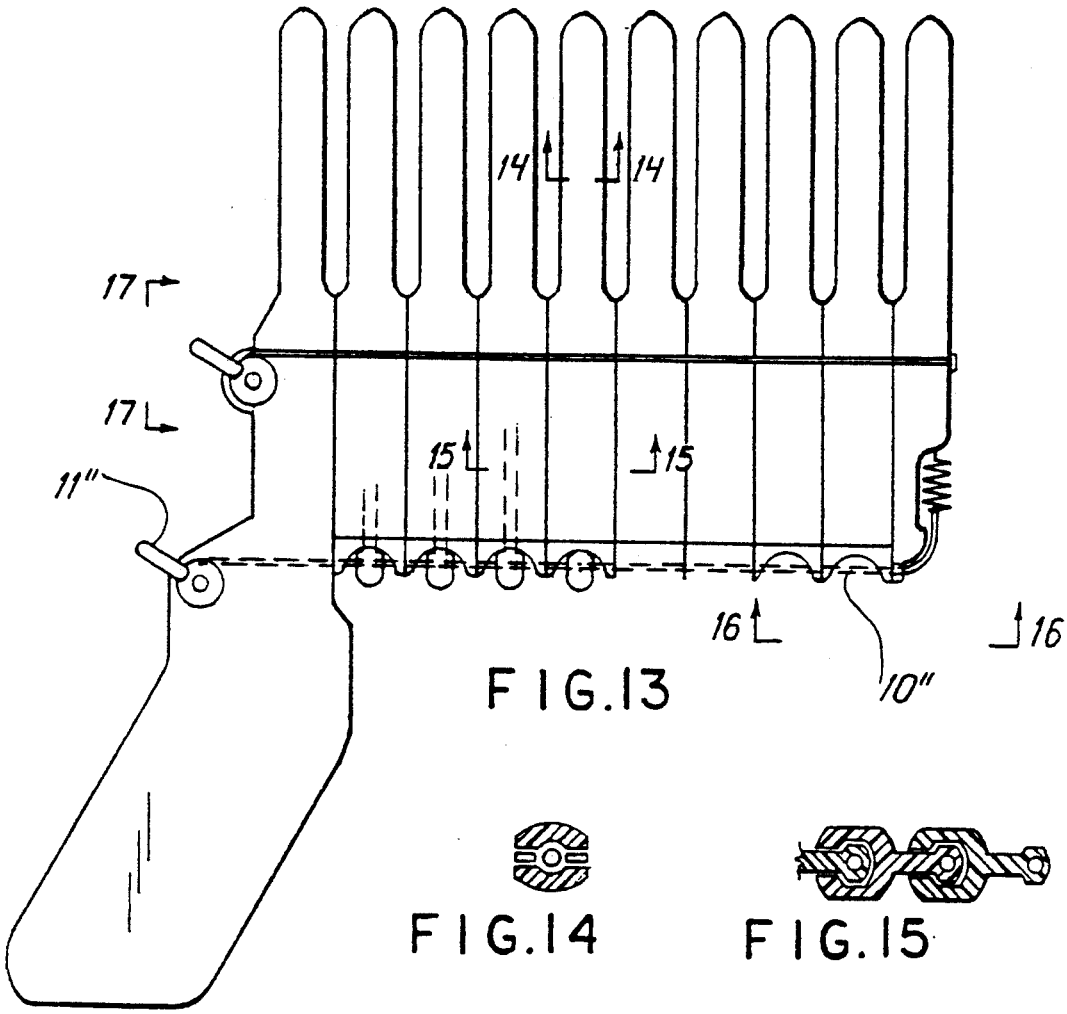
FIG.13
FIG.14
FIG.15
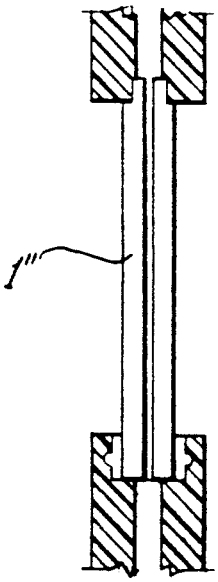
FIG.18
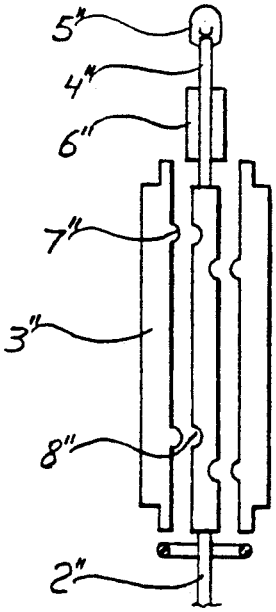
FIG.19
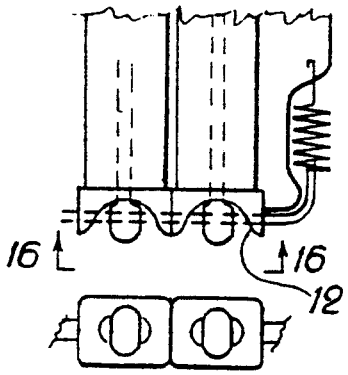
FIG.16
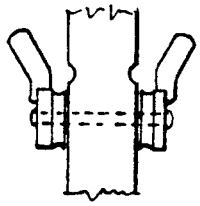
FIG.17

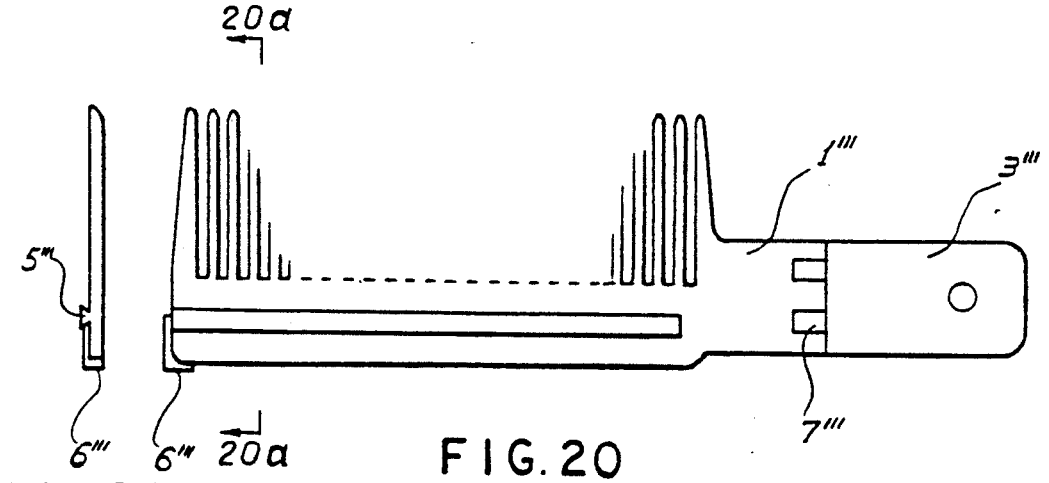
FIG. 20
FIG. 20a
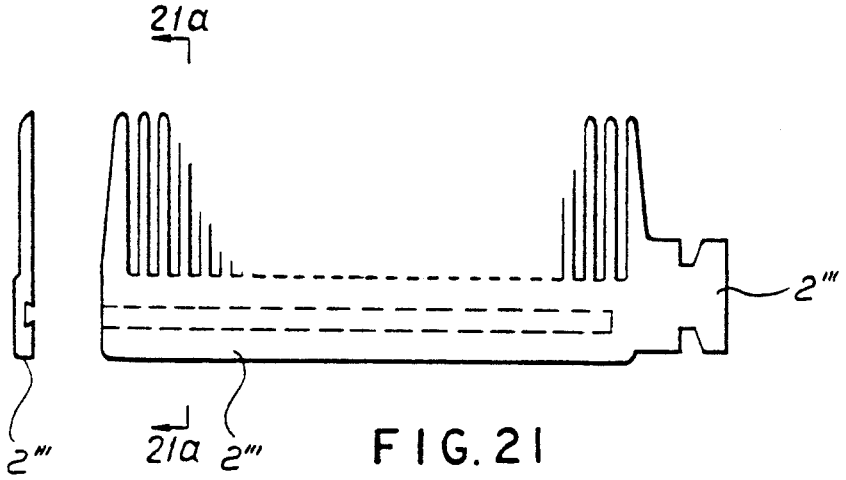
FIG. 21
FIG. 21a
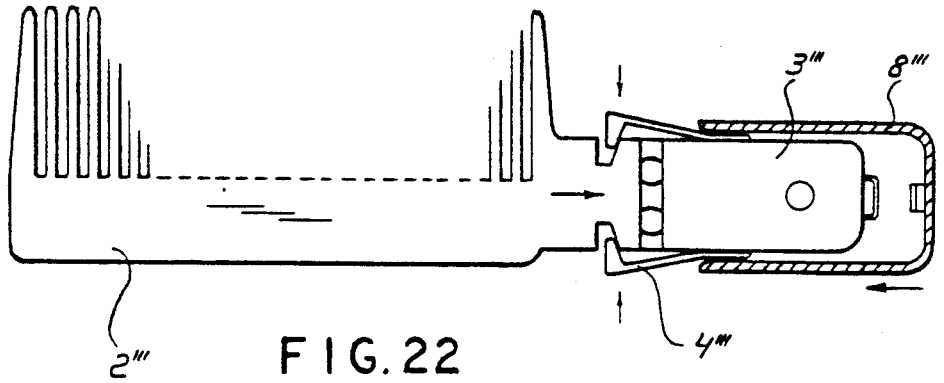
FIG. 22

COMB

BACKGROUND OF THE INVENTION

The present invention relates to combs which are provided as usual with a plurality of elongated prongs with gaps therebetween for combing hair.

Combs of the above mentioned general type are known in the art. Some of the combs are disclosed in U.S. Pat. Nos. 4,230,134, 4,345,608, 4,487,211, 4,502,498, 4,520,565. It is desirable to further improve existing combs, and in particular to design such combs which will allow clamping and releasing of substantial quantity of hair.

SUMMARY OF THE INVENTION

Accordingly, it is an object of the present invention to provide a comb which is a further improvement of existing combs and which allows easy, simple and reliable clamping and releasing of hair.

In keeping with these objects and with others which will become apparent hereinafter, one feature of the present invention resides, briefly stated, in a comb which has a plurality of elongated prongs each composed of two parts, user-operated means for moving said parts of said prongs relative to one another so as to reduce gaps between the prongs and clamp hair, and elastic means for moving the parts of the prongs relative to one another to an initial position so as to increase the gaps upon release of the user-operated means and release the clamped hair.

When the comb is designed in accordance with the present invention, it allows easy clamping and releasing of substantially quantities of hair. In the clamping condition substantial mass of hair is held in stretched condition from hair roots to the point of fixation, and thereby a hair-cutting device with attachements having greater sizes than the conventional attachements can be utilized.

Hair cutting with the use of attachements is performed in the following manner:

The comb is introduced into hair against the direction of hair growth by sliding over the scalp, then the hair are combed in a vertical direction from the spherical surface of head to a length which insignificantly exceeds the length of the used attachement, and then the comb is transferred to its clamping position. The hair are stretched and retained in a stretched position by one hand, while hair cutting is performed by a hair-cutting device with the attachement of a desired size by means of another hand.

The second method of hair cutting with the inventive comb is performed in the same sequence, with the single difference that the comb is pulled over the needed length of cutting of a lock, and the hair after clamping are cut by the cutting device along the upper surface of the comb. In this case the cutting is performed over several surfaces, which is very convenient for geometrical rectangular cuts, such as for example flat top, however is not convenient for oval-shape cuts. For this case the comb is formed with changing shape of its surfaces for example flexible.

When the latter mentioned comb is used, the shape of oval cut is to be selected, and usually it is the shape of the oval of head at a required angle. The comb is transferred to the relaxed condition, then it is placed to the corresponding part of the head and is slightly pressed to the head, and therefore the comb assumes the oval shape of this portion of the head and is transferred to the stiff position. Other actions correspond to the actions of the first described method.

In accordance with another embodiment of the invention means can be provided for determination of length of hair of length of cut. These means can be formed by a plastic soft tape which is colored in different colors after each inch can be glued to critical points of hair measurements (3 or 4 depending on skills of a hair cutter) to the roots of a lock composed of 3–4 hairs or to the scalp. These means can be formed by a measuring tape which is incorporated in the comb and measured the length of the lock from the ends of the prongs of the comb to the hair roots. The length from the base of the comb to the hair root is determined by an angle of inclination of the comb relative to a horizontal plane, and for this purpose a water level can be used.

For a smooth transition from short hair to long hair combs which are bent in a vertical direction along a horizontal axis.

The novel features of the present invention are set forth in particular in the appended claims. The invention itself, however, both as to its construction and its method of operation will be best understood from the following description of preferred embodiments, which is accompanied by the following drawings.

BRIEF DESCRIPTION OF THE DRAWINGS

FIG. 13 is a view of the comb in accordance with a third embodiment of the invention;

FIGS. 14, 15, 16, 17 are views showing two sections and two fragment of the comb of FIG. 13;

FIGS. 18 and 19 are views showing elements of prongs of the comb of FIG. 13;

FIG. 20 is a view showing a main part of a comb in accordance with a fourth embodiment of the invention;

FIG. 21 is a view showing a slider of the comb of FIG. 20: and

FIG. 22 is a view showing the comb of the fourth embodiment in assembled condition.

DESCRIPTION OF PREFERRED EMBODIMENTS

Figure 1:
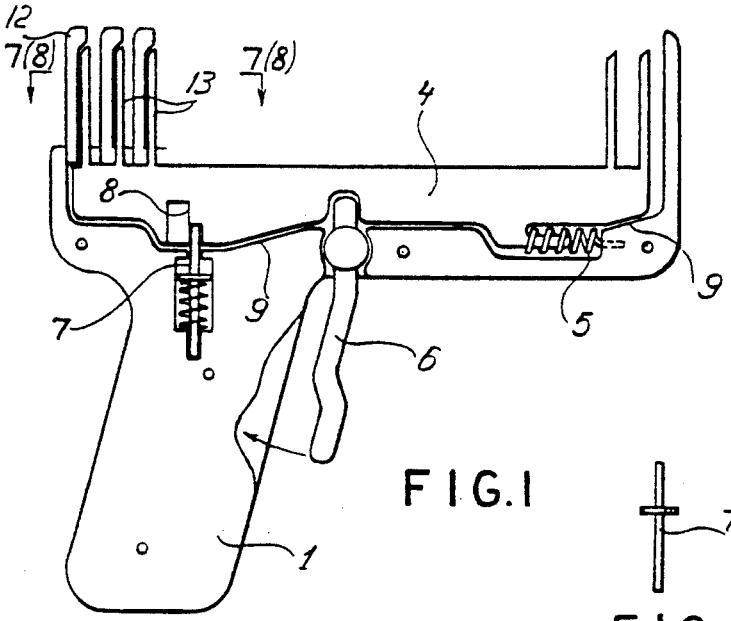
FIG. 1 is a view showing a main part of a comb in accordance with one embodiment of the present invention.
Figure 5:
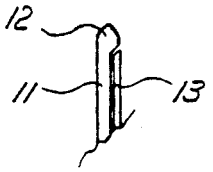
FIG. 5 shows upper portions of prongs of the comb of FIG. 1.
Figure 4:
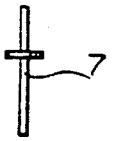
FIG. 4 shows a fixator of the comb of FIG. 1.
Figure 6:
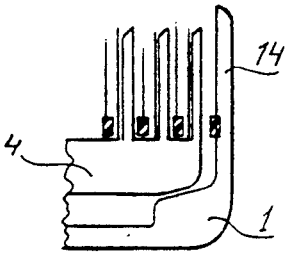
FIG. 6 shows an end part of the main part of FIG. 1.
Figure 2:
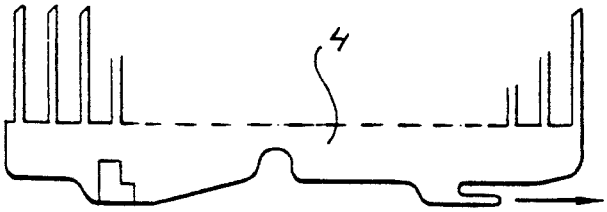
FIG. 2 shows a slider of the comb of FIG. 1.
Figure 7:
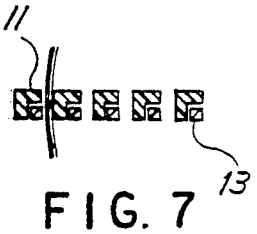
FIGS. 7 and 8 are sections taken through prongs of the comb of FIG. 1 is released and clamping positions correspondingly.
Figure 3:
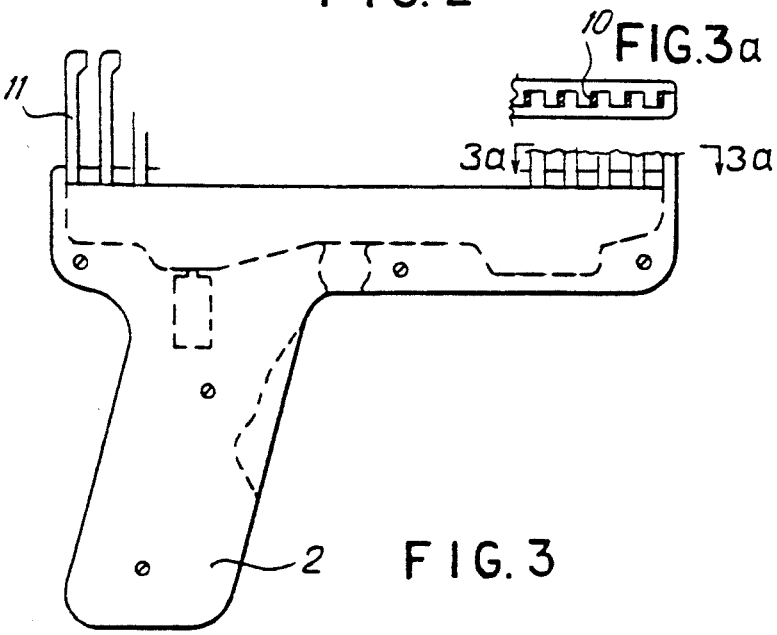
FIG. 3 is a view showing a cover of the comb of FIG. 1.

A comb in accordance with a first embodiment shown in FIGS. 1–8 has a main part 1 and a cover 2 which are connected with one another by a plurality of pins and the like. The pins can be formed of two parts screwable in one another, so that if needed the comb can be disassembled. A slider 4 is longitudinally displaceable in a recess formed by the elements 1 and 2. The slider is spring-biased to the left by a spring 5 and can be moved two the right by a user who presses a lower arm of a pivotable lever 6 toward the handle while an upper arm of the lever engages in the recess of the slider and pushes the latter to the right. In the position in which the slider is withdrawn to the right, a pin of a spring-biased fixator 7 moves upwardly and engages behind a shoulder 8 so as to retain the slider in such position. The slider 4 on the one hand and the main part 1 and the cover 2 on the other hand are provided with cooperating inclined surfaces 9, so that when the slider is displaced to the right, it is simultaneously moved upwardly. Elastic washers 10 are provided for preventing penetration of hair into gaps between the parts of the comb.

The cover is provided with prongs 11 which are relatively thick, angled and have upper heads 12 with lower inlined surfaces. The main part 1 has thinner prongs 13 and a single right limiting prong 14. As can be seen from FIGS. 7 and 8 the angular prongs 11 partially surround the thin prongs 13.

Figure 8:
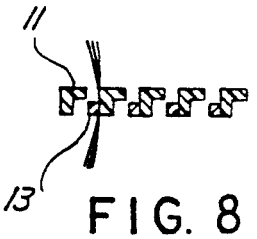
Figure 11:
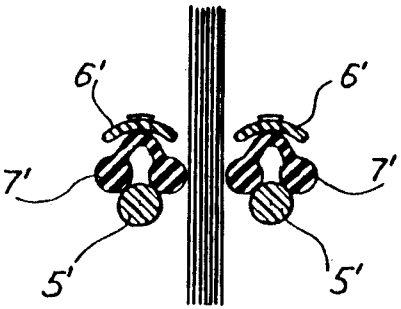
FIGS. 11 and 12 show a section through the comb of FIG. 9 showing the prongs in released and clamping positions correspondingly.

The comb of the first embodiment operates in the following manner:

In an initial open position the slider is retained by the spring 5 and elastic force of the rubber washers 10, as shown in FIG. 1. Hair is combed by the comb in this position and enter the spaces between the prongs 11 and 13. In order to clamp the hair, the slider 4 is moved to the left and upwardly by actuation of the lever 6 and cooperation of the inclined surfaces 9 till the fixator 7 fixes the closed position. The hair clamped between the prongs as shown in FIG. 8, uniformly along their whole length due to the inclined surfaces on the prong heads 12. For transferring the comb to the initial position the pin of the fixator 7 is pushed downwardly, for example by a not shown outwardly accesible projection, and the spring and the washers return the slider to its left, shown position.

The comb in the embodiment of FIGS. 9-12 has a main part 1' and a lever 2' pivotally connected to the main part and having a left end projection adapted to slide between the main part 1' and a guide 3'. A slider 4' is provided with a plurality of substantially round prongs 5' while the main part is provided with a plurality of substantially arcuate prongs 6' which partially surround the prongs 5' with interposition of rubber washers 7' . End rubber washers 8' and 9' are arranged between the main part 1' and the slider 4'. The main part 1' and the slider 4' have cooperating inclined surfaces 10'.

Figure 12:
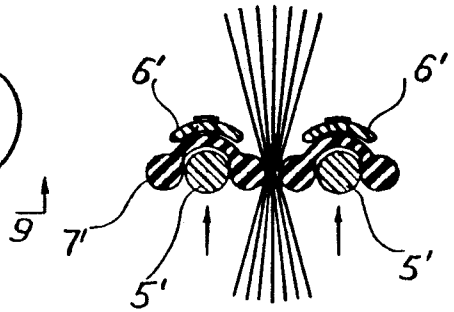
Figure 9:
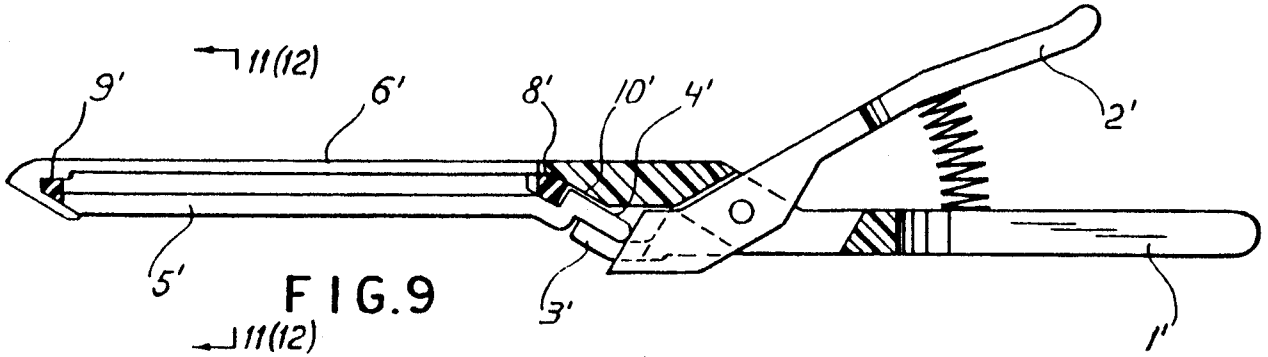
FIG. 9 is a sectioned side view of a comb in accordance with another embodiment of the invention.
Figure 10:
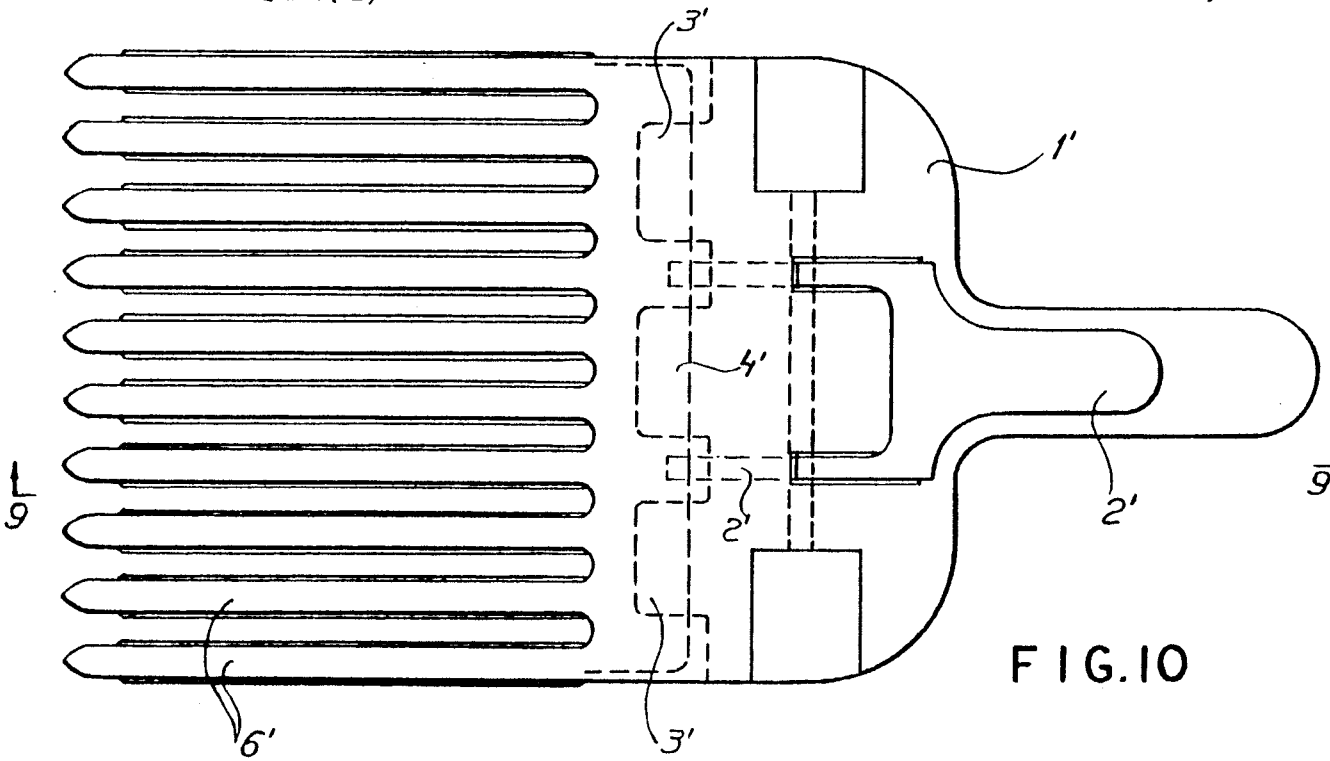
FIG. 10 is a plan view of the comb of FIG. 9.

The comb is retained in its initial open position shown in FIG. 9 by the spring and the washers. In this position hair are combed and enter the gaps between the prongs, In order to clamp the hair, the handles formed by the right end portions of the main part 1' and the lever 2' are pressed toward one another to overcome the resistance of the spring and the washers. The left end projection pushes the slider 4' to the left and upwardly and the prongs 5' come to abutment against the washers 7' and in particular move into their recesses, so that the washers 7' are spread laterally and clamp the hair therebetween as shown in FIG. 12. In order to release the hair, it sufficies to reduce the pressing force of a hand onto the handles so that the spring and the washers apply a return force to the corresponding parts of the comb.

In the embodiment of FIGS. 13-19 the comb includes identical sections of prongs assembled in a comb portion with the exception of a central portion, an end handle and cooperating prongs which are rounded at end sides. Each prong has a main tooth part 1'' with a central cable 2'' extending through it and holding movable jaws 3'' in an initial position. In this position recesses 8'' of the cable 2'' and projections 7'' of the jaws coincide with one another. In this position the hair are combed. In order to transfer the comb to the closed position for clamping hair, the cable is pulled downwardly in FIG. 19, the projections and recesses are verically offset relative to each other and the jaws 3'' are spread apart so that the hair are clamped between the outer smooth surfaces of the spread jaws. During this movement of the cable a rubber string 4' is stretched. In order to transfer the comb to the initial open position, the cable is released and returned to its initial position under the action of compression of the string 4'' . As can be seen from FIG. 19, the rubber string 4'' is arranged with its two ends in the head 5'' and tube 6'' correspondingly.

When the comb is returned to its initial position, the projections 7'' again engage in the grooves 8'' and the jaws are moved toward one another to release the hair. As can be seen from FIG. 15, the lower part of one prong is formed as a bar which is convex from one side and concave from another side. The prongs are assembled into a pack by a fixingf device, to form a comb. The fixing device includes a cable 10'' and a handle 11''. When the cable 10'' is pulled the ends of the cables 2'' of all prongs slide over inclined surfaces of cams 12'' and pulled downwardly, as explained hereinabove. The comb also has a measuring device arranged in an end side part of a central tooth. It is formed as a measuring tape device with a tape composed of a soft band extending through the middle of the central tooth. The front face of the latter has a transparent window to read values of hair length on the tape. On the end side part of the tape there is a small clamp which is fixed to the roots of a small hair lock before the beginning of measurements. The length of the hair is readable on the tape through the window. After the end of the measurements the tape is pulled back by a spring.

In the embodiment of FIGS. 20-22 the comb has a main part 1''' and a slider 2''' having interengaging dovetail shaped projections and grooves 5 '''. A limiting member 6''' holds the comb is an open position in which the prongs of the main part and the slider coincide with one another. Rubber washers 7''' arranged in slots of the main part 1''' are formed as compression spring members and hold the slider in this position. The washers are located between a movable handle 3''' and the slider 2'''. A springy member 4''' is provided with two inwardly directed teeth while the slider is provided with two recesses having inclined sides. The comb further has a case 5'''.

In the open position when the prongs of the slider and the main part coincide with one another, hair are combed with the comb and engaged between the prongs. In order to clamp the hair, the springy member 4''' is compressed, its projections are inserted into the recesses of the slider, and the slider is displaced to the right. The prongs of the slider are displaced from the prongs of the main part and the hair are clamped. When the hand pressure on the springy member is released, the projections jump out of the recesses and the previously compressed washers return the slider to its initial position.

The invention is not limited to the details shown since various modifications and structural changes are possible without departing in any way from the spirit of the present invention.

What is desired to be protected by Letters Patent are set forth in particular in the appended claims.

I claim:

1. A comb, comprising a plurality of prongs, each of said prongs being composed of two prong parts movable relative to one another between an open position in which hair can engage between said prongs and a closed position in which hair is clamped between the prongs;

user-actuated means for moving said prong parts from one of said positions to another of said positions;

means for automatically returning said prong parts from said another position to said one position when the user stops acting on said user-actuated means, said prong parts including a first group of prong parts and a second group of prong parts;

a support provided with one group of said prong parts; and a slider movable relative to said support by said user-actuated means and provided with another group of said prong parts, said user-actuating means including a lever turnable relative to said support and engaged with said slider so as to displace the latter, said returning means including spring means and compessible washer means which simultaneously prevent engaging of hair into gaps between said support and said slider.

2. A comb, comprising a plurality of prongs, each of said prongs being composed of two prong parts movable relative to one another between an open position in which hair can engage between said prongs and a closed position in which hair is clamped between the prongs;

user-actuated means for moving said prong parts from one of said positions to another of said positions;

means for automatically returning said prong parts from said another position to said one position when the user stops acting on said user-actuated means, said prong parts including a first group of prong parts and a second group of prong parts;

a support provided with one group of said prong parts; and a slider movable relative to said support by said user-actuated means and provided with another group of said prong parts, said slider and said support having cooperating inclined surfaces so that under action of said user-actuated means said slider and said another group of prong parts move in two mutually transverse directions relative to said support and said one group of prong parts.

3. A comb as defined in claim 2, wherein said prong parts of one of said groups are angular in a cross section and at least partially surround said prong, parts of another of said group.

4. A comb as defined in claim 2 wherein said prong parts of one of said group have heads with inclined lower surfaces cooperating with upper ends of said prong parts of another of said groups.

5. A comb as defined in claim 2, wherein said user-activated means is formed as a scissors-type device including one arm connected with said support and another arm connected with said slider.

6. A comb as defined in claim 2, wherein said prong parts of one of said group are introduced into recesses of said prong parts of another of said group with interposition of elastic elements which are thereby spread apart to form said closed position.

7. A comb as defined in claim 2, wherein each of said prongs includes a further central prong part which is movable longitudinally and surrounded by said two first mentioned prongs parts which move transverse toward said central prong part to said open position and away of said central prong part to said closed position.

8. A comb as defined in claim 7, wherein said central prong part has recesses while said two first mentioned prong parts have projections which in said open position coincide with each other and in said closed position are longitudinally offset and disengaged from each other.

9. A comb as defined in claim 2, wherein one of said main part and said slider is provided with said returning means formed by a compressible element while another of said main part and said slider is provided with recesses having inclined surfaces, said user-actuating means including a springy member with projections engageable in said recesses so as to displace said slider relative to said main part.

* * * * *